US006354258B1

(12) United States Patent
Abele et al.

(10) Patent No.: US 6,354,258 B1
(45) Date of Patent: Mar. 12, 2002

(54) LIGHTWEIGHT VALVE

(75) Inventors: Marcus Abele, Marxzell-Burbach; Thomas Glas, Rheingelden; Andreas Von Känel, Waiblingen; Walter Krepulat; Martin Lechner, both of Stuttgart; Christoph Steinmetz, Ludwigsburg; Frank Sticher, Bad Homburg, all of (DE)

(73) Assignee: Mahle Ventiltrieb GmbH, Stuttgart (DE)

( * ) Notice: Subject to any disclaimer, the term of this patent is extended or adjusted under 35 U.S.C. 154(b) by 0 days.

(21) Appl. No.: 09/601,497

(22) PCT Filed: Jan. 28, 1999

(86) PCT No.: PCT/EP99/00561

§ 371 Date: Aug. 1, 2000

§ 102(e) Date: Aug. 1, 2000

(87) PCT Pub. No.: WO99/40295

PCT Pub. Date: Aug. 12, 1999

(30) Foreign Application Priority Data

Feb. 3, 1998 (DE) ..... 198 04 053

(51) Int. Cl.[7] ..... F02N 3/00

(52) U.S. Cl. ..... 123/188.3; 29/888.45; 251/356

(58) Field of Search ..... 123/188.3; 29/888.45; 251/356

(56) References Cited

U.S. PATENT DOCUMENTS

| | | | | |
|---|---|---|---|---|
| 1,294,416 | A | | 2/1919 | Dady |
| 1,506,900 | A | | 9/1924 | Greiner et al. |
| 1,557,022 | A | | 10/1925 | Chilton |
| 1,727,621 | A | * | 9/1929 | Taub |
| 2,371,548 | A | | 3/1945 | Saffady |
| 2,398,514 | A | | 4/1946 | Bronander |
| 2,439,240 | A | | 4/1948 | Cummings |
| 2,731,708 | A | | 1/1956 | Kubera |
| 2,734,008 | A | | 2/1956 | Kirkpatrick et al. |
| 4,834,036 | A | | 5/1989 | Nishiyama et al. |
| 5,771,852 | A | | 6/1998 | Heimann, Jr. et al. |

FOREIGN PATENT DOCUMENTS

| | | |
|---|---|---|
| DE | 910 492 | 5/1954 |
| DE | 762 642 | 8/1954 |
| DE | 1 960 331 | 6/1971 |
| DE | 32 33 392 | 3/1984 |
| DE | 36 25 560 | 2/1988 |
| EP | 0 091 097 | 10/1983 |
| JP | 60-169611 | 9/1985 |

* cited by examiner

*Primary Examiner*—Andrew M. Dolinar
*Assistant Examiner*—Katrina B. Harris
(74) *Attorney, Agent, or Firm*—Collard & Roe, P.C.

(57) ABSTRACT

The invention relates to a hollow-stem valve for an internal combustion engine. The valve has a ratio of wall thickness to stem diameter of less than 1:3. The aim of the invention is to minimize the deformation of the valve head. To this end, the valve disk rests directly against the stem.

6 Claims, 2 Drawing Sheets

LIGHTWEIGHT VALVE

CROSS REFERENCE TO RELATED APPLICATIONS

Applicants claim priority under 35 U.S.C. §119 of German Application No. 198 04 053.9 filed Feb. 3, 1998. Applicants also claim priority under 35 U.S.C. §120 of PCT/EP99/00561 filed Jan. 28, 1999. The international application under PCT article 21(2) was not published in English.

The invention relates to a lightweight valve for an internal combustion engine.

Such a valve is known from DE 36 25 590 A. The valve disclosed in said document is expected to make a contribution to the development of a type of engine that has heat-insulated combustion chambers. The valve disk facing the combustion chamber is designed for said purpose with particularly thin walls. Said measure is intended to effect low absorption of heat of the valve disk and, accordingly, low heat losses. In order to make it possible to provide the valve disk with thin walls, provision is made for additional structural components that extend the valve stem and serve as a support between the valve disk and the valve stem.

Furthermore, lightweight valves are known, for example from DE 1 960 331 A, EP 0 091 097 A, U.S. Pat. No. 2,731,708, and U.S. Pat. No. 1,294,416.

In the development of modern engines, thought is increasingly given also to the idea of employing an electromagnetic, pneumatic or hydraulic control of the valve drive. The driving output that has to be expended for such valve drives increases exponentially with the weight of the oscillating masses, i.e. with the weight of the valves. This leads to the need for further optimization of lightweight valves with respect to their weight, i.e. for further minimizing particularly the wall thickness.

With most known lightweight valves, the desire to create in the interior of the valve the largest possible cavity leads to the fact that a relatively large, unsupported bottom surface facing the combustion chamber is formed. During the operation of the valve, said bottom surface is deformed by the combustion pressure especially if the wall thickness has been minimized. The displacements caused by such deformations on the peripheral surface of the valve seat contribute to premature wear of the seat and additional stressing of the valve. Furthermore, such deformation causes additional stress within the zone of the joint between the valve disk and the valve cone, with the risk of rupture of the joint.

Supporting of the valve disk is known per se from U.S. Pat. No. 2,439,240. However, the solution described in said patent document requires substantial engineering expenditure conditioned on account of the formation of the support.

Another attempt to provide a solution is known from U.S. Pat. No. 2,371,548, where the valve disk is supported in the center, and whereby the forces absorbed by the support are introduced into the end of the stem via a piece of tubing arranged within the stem. Said solution requires substantial expenditure and the desired effect of minimal deformation of the valve head under load is achieved only in part. In particular due to the flow of force via the stem, said solution even leads to a deterioration of the deformation values under identical geometric conditions, as compared to the valve known, for example from EP-OS 091 097.

Supporting the valve disk against the stem is known also from DE 36 25 590 A. The solutions disclosed by said patent, however, have the drawback that the support is realized with the help of an additional intermediate piece that is fixed between the valve disk and the stem, and that the wall thickness of the valve disk is very low, so that deformation of the head of the valve has to be expected.

Therefore, the invention deals with the problem of increasing the rigidity of the valve head of a lightweight valve in a simple way, and of facilitating the manufacture of the valve.

The problem is solved for valves of the above type by a valve in accordance with the invention.

With valves as defined by the invention it is possible to realize deformation values that are within the range of the values of valves having a valve head made of full material. The mass reduction of such lightweight valves amounts to at least 40% as compared to solid-material steel valves.

A valve in accordance with the invention is a departure from the type of design customarily employed heretofore for lightweight valves. The valve cone no longer forms one single piece jointly with the stem of the valve, but rather is produced as an individual component. Moreover, the valve stem is extended up to the valve disk, and has an increased diameter, if need be.

The stem is preferably constructed as a drawn or welded tube or consists of solid material.

The valve cone is preferably fixed on the stem by soldering or welding.

"Radially on the inside" is understood to mean: removed from the outside diameter of the valve disk.

The valve as defined by the invention creates a lightweight valve that has high rigidity also with thin walls, and its weight is accordingly lower.

The invention is based on the basic idea of absorbing the gas forces acting on the valve disk by directly supporting the valve disk against the stem. By supporting the valve disk against the valve stem, a rotational surface support with an approximately triangularly shaped cross section is obtained in conjunction with the valve stem.

A lightweight valve is in fact known from U.S. Pat. No. 4,834,036 in connection with which the stem extends up into the range of the valve disk. The valve head, however, is a lightweight, cast or forged solid material based on titanium such as titanium aluminide, which means that said valve in not included in the category of hollow valves as defined by the invention.

Furthermore, a valve is known from U.S. Pat. No. 1,506,900 dating back to the year 1924. Said valve has a similar structure; however, the invention is different from said structure in that it has a different wall thickness ratio and a different design with respect to the way in which the end of the stem is tied to the valve disk. The relatively thin wall thickness of the valve disk disclosed in said patent is unfavorable in terms of strength as compared to the valve cone, as is the breakthrough in the valve disk for receiving the end of the valve stem.

The invention is explained in the following in greater detail with the help of exemplified embodiments. In the drawing, FIG. 1 shows a cross section through a valve as defined by the invention.

A valve 1 for an internal combustion engine consists of a stem 2, a valve base not shown, a funnel-like valve cone 3, and a valve disk 4 produced as one single piece with the valve cone. The diameter of the stem is expanded at the level of the valve cone 3. At its bottom end, the stem 2 is welded together with the valve disk 4. At its top end, the valve cone 3 is welded together with the stem 2. The valve cone 3, the valve disk 4 and the extended lower stem end connecting the cone and the disk jointly form a rotational surface support. The wall thickness of the valve cone 3 is lower than the wall thickness of the valve disk 4.

Figure 1:
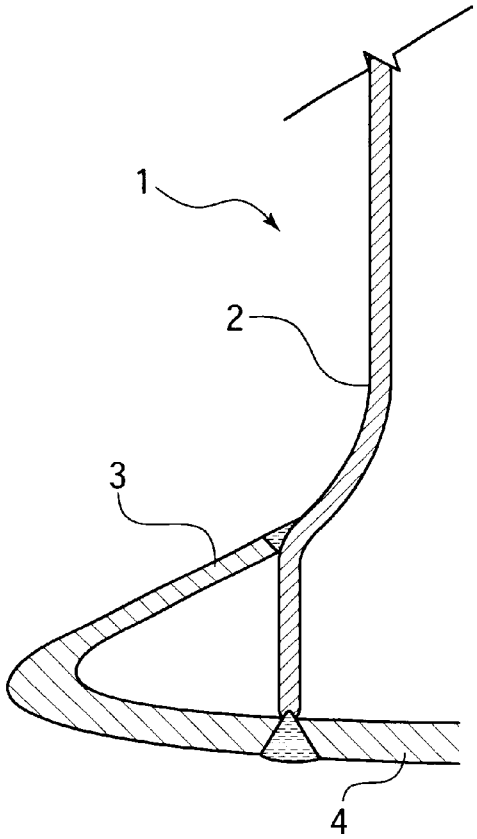
Figure 2:
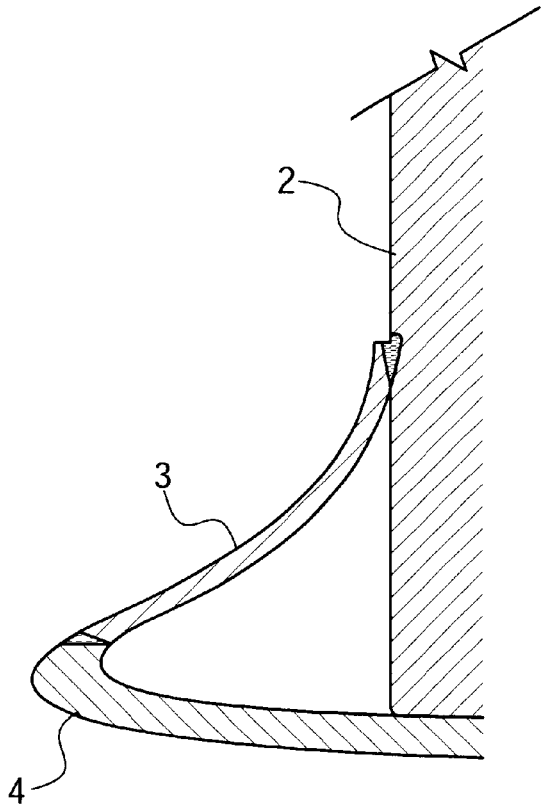
FIG. 2 shows another exemplified embodiment, with the valve disk and cone as two components.

In the embodiment shown in FIG. 2, the valve disk 4 and the valve cone 3 do not form one single piece, but are joined with each other by a welding seam. The stem consists of solid material, whereby the stem also may have a smaller diameter beneath the welding seam than within the zone located above the welding seam.

Figure 3:
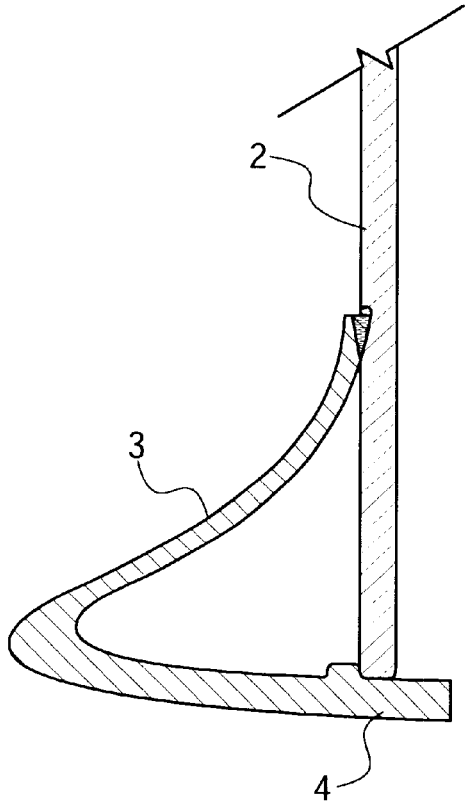
FIG. 3 shows an exemplified embodiment with a centering for the base of the stem.

In FIG. 3, the valve disk 4 and the valve cone 3 are made as one single piece and provision is made in the valve disk 4 for a centering for the end of the stem 2. Provision is made for a welded joint only between the upper end of the valve cone 3 and the stem. In the present embodiment, too, the wall thickness of the valve disk 4 is greater than the wall thickness of the valve cone 3.

Figure 4:
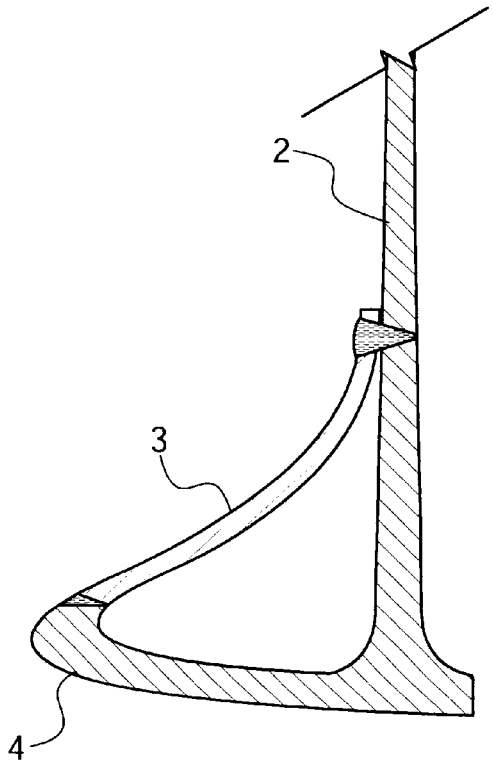
FIG. 4 shows an exemplified embodiment with a support molded onto the valve disk.

FIG. 4 shows a valve disk with a molded-on, collar-like support according to a further embodiment of the invention.

What is claimed is:

1. A lightweight valve for an internal combustion engine comprising:

(a) a valve stem;

(b) a valve cone connected at an upper end to said valve stem; and (c) a valve disk connected to said valve cone, said valve disk and said valve cone jointly forming a cavity, said valve disk having a radially interior portion forming a connection with an end of said valve stem selected from the group consisting of:

(i) the end of said valve stem resting directly against said valve disk;

(ii) the end of said valve stem resting directly against a support integral with said valve disk; and (iii) said valve stem being integral with said valve disk;

wherein each of said valve disk and said valve cone has a wall thickness less than one-third the diameter of said valve stem and the ratio of the wall thickness of said valve cone to the wall thickness of said valve disk is less than 0.7.

2. The lightweight valve according to claim 1 wherein the valve stem is welded to said valve disk.

3. The lightweight valve according to claim 1 wherein said valve stem has a larger stem diameter at the level of said valve cone.

4. The lightweight valve according to claim 3, wherein the larger stem diameter forms a conical end welded flush with said valve cone.

5. The lightweight valve according to claim 1 wherein the support is molded on said valve disk and supports said valve disk against said valve stem.

6. The lightweight valve according to claim 1 wherein said valve cone is integral with said valve disk.

* * * * *